United States Patent [19]

Leeming

[11] Patent Number: 4,919,781

[45] Date of Patent: Apr. 24, 1990

[54] FLUORINE GENERATING ELECTROLYTIC CELLS

[75] Inventor: Roland Leeming, Preston, United Kingdom

[73] Assignee: British Nuclear Fuels plc, Risley, England

[21] Appl. No.: 268,284

[22] Filed: Nov. 7, 1988

[30] Foreign Application Priority Data

Nov. 20, 1987 [GB] United Kingdom ..... 8727188

[51] Int. Cl.[5] ..... C25B 9/00

[52] U.S. Cl. ..... 204/241; 204/274; 204/60; 204/247

[58] Field of Search ..... 204/241, 243 R, 274, 204/247, 60

[56] References Cited

U.S. PATENT DOCUMENTS

| | | | |
|---|---|---|---|
| 2,568,844 | 9/1951 | Benning et al. | 204/247 X |
| 3,000,801 | 9/1961 | Davies et al. | 204/60 |
| 3,956,098 | 5/1976 | Welch et al. | 204/286 |
| 4,139,447 | 2/1979 | Faron et al. | 204/247 X |

FOREIGN PATENT DOCUMENTS

| | | |
|---|---|---|
| 1119235 | 12/1961 | Fed. Rep. of Germany . |
| 2145063 | 2/1973 | France . |
| 1303389 | 1/1973 | United Kingdom . |
| 2135334 | 8/1984 | United Kingdom . |

*Primary Examiner*—Donald R. Valentine
*Attorney, Agent, or Firm*—William R. Hinds

[57] ABSTRACT

A fluorine-generating electrolytic cell has the base 12 thereof insulated electrically by a layer 10 of plastics material such as PTFE which is held against the cell base by means of structure extending between cooling coils 24 of the cell and the layer 10.

8 Claims, 3 Drawing Sheets

FLUORINE GENERATING ELECTROLYTIC CELLS

BACKGROUND OF THE INVENTION

This invention relates to fluorine-generating electrolytic cells.

The production of fluorine by the electrolysis of a fused electrolyte containing potassium fluoride and hydrogen fluoride is well known. During electrolysis heat is generated and the electrolyte must be cooled. The cooling of the electrolyte has been achieved by the provision of cooling tubes immersed in the electrolyte. In one form of cell used for the large scale production of fluorine the electrolyte is cooled by cooling coils. A cell of this kind is hereinafter referred to as being a fluorine-generating electrolytic cell of the kind specified. In such a cell, the cooling coils may also act as cathodes. The cooling coils can be mild steel.

Hitherto, cells of the kind specified have been operated with a water-cooled base so that a layer of "frozen" electrolyte is formed on the base so as to electrically insulate the base and hence prevent the generation of hydrogen at the cell base, this generation being undesirable since the hydrogen could otherwise migrate to the anode compartments of the cell where it could interact with fluorine with potentially serious consequences.

British Patent Specification GB-A-2135334 discloses an alternative approach in which, instead of insulating the cell by means of a solid layer of electrolyte, a polymeric material such as polytetrafluoroethylene is applied to the cell base. The polymeric layer need only be of the order of 2 mm thick (in contrast with a solid electrolyte layer typically of the order of 50 mm thick) with the advantage that the anodes can be made longer.

The present invention addresses the problem of securing the insulating layer to the cell base without adversely affecting the integrity of the cell base.

FEATURES AND ASPECTS OF THE INVENTION

According to the present invention there is provided a fluorine-generating electrolytic cell having a base, cooling coils in the cell for cooling the electrolyte and being displaced from the base, a layer of material disposed on the base to electrically insulate the base, and means bridging the space between the cooling coils and an upwardly presented face of the layer so as to hold the layer against the base.

By using the cooling coils in holding the insulating layer in place, the need to make changes to the cell vessel is avoided and installation and removal of the layer is relatively easy and inexpensive. Also, by using an insulating layer, all of the electrolyte is molten with the advantage that a smaller temperature gradient through the depth of the electrolyte results, which leads to improvements in mass transfer.

DESCRIPTION OF THE PREFERRED EMBODIMENT

The invention will now be described by way of example only with reference to the accompanying drawings in which.

Typically, a fluorine-generating electrolytic cell comprises a mild steel tank jacketted on the sides so that steam can be applied to the jackets to maintain the KF.2HF electrolyte in molten condition when the cell is not in production. In conventional fluorine cells, the base also is jacketted so that the electrolyte in this region can be frozen by the application of coolant but this is unnecessary in the present invention. A series of water-cooled coils connected to inlet and exit headers divide the tank transversely and function as water-cooled cathodes. The cell lid has a series of openings into which anode assemblies fit so that each anode assembly is interposed between a pair of coils.

Each anode assembly consists of a flat plate of mild steel to the underside of which is attached a rectangular Monel gas separating skirt inside which are located a pair of anode blocks. The anodes are insulated from the skirt assembly and the cell top by means of neoprene or fluoro-elastomer gaskets depending on the duty. To ensure no mixing of the gaseous products, each skirt protrudes a short distance into the electrolyte to divide th cell into a series of fluorine compartments and one hydrogen compartment. Fluorine from the anode assemblies is collected in a common manifold while the hydrogen leaves at an offtake located at one end of the cell. Provision is made in the cell lid for a liquid hydrogen fluoride feed pipe, electrolyte sample dip pipe, electrolyte thermocouple wells, and a nitrogen purge to both the hydrogen side and each individual anode compartment. Electrical contact to each anode is provided by a mild steel/nickel hanger secured to the block by means of a nickel oversprayed coating. The hanger, which has a nickel base plate, has two mild steel vertical threaded studs which protrude through the top of the gas separating skirt.

Electrical connections from the pairs of anodes are made to a positive busbar running the length of the cell. The negative busbar is connected to the cell body which is thus at the same potential as the cathodes.

Figure 1:
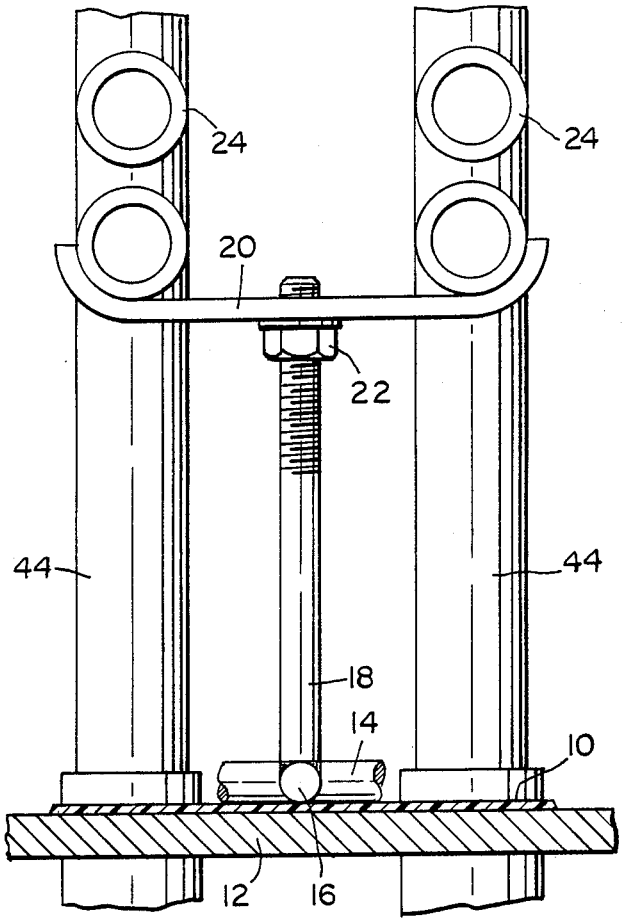
FIG. 1 is a fragmentary vertical section through a fluorine-generating electrolytic cell showing one form of the invention.
Figure 2:
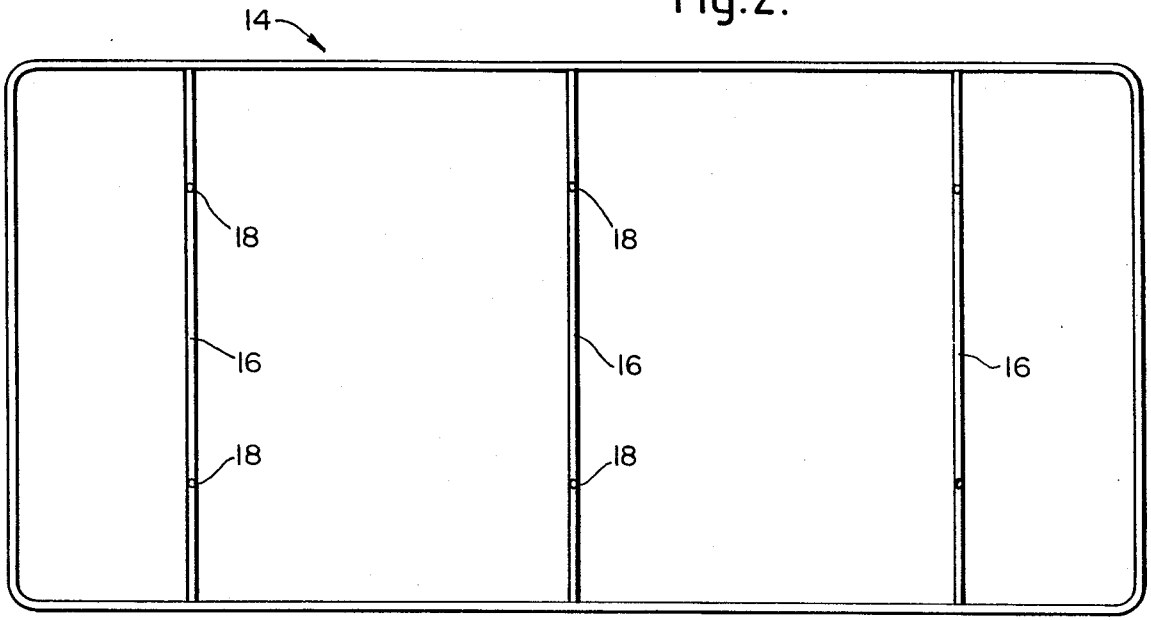
FIG. 2 is a plan view of the clamping frame of the clamping assembly shown in FIG. 1.
Figure 3:
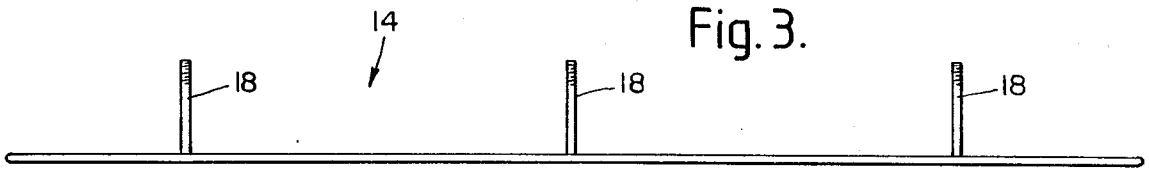
FIG. 3 is a side view of the clamping frame.

Referring now to FIGS. 1–3, the frozen layer of electrolyte is replaced by a thin layer 10 (typically 2 mm) of a plastics material such as a fluorinated polymer, eg polytetrafluoroethylene or polyvinyldifluoride, or polypropylene. The layer may comprise a number of separation sections or sheets disposed side-by-side. The layer 10 having an upwardly presented face 9 is held against the base 12 of the cell by a frame 14 (which is shown in greater detail in FIGS. 2 and 3). The frame 14 is of generally rectangular configuration and has a number of cross-members 16 extending between its sides. A number of studs or struts 18 extend upwardly from the frame cross-members. At its upper end each stud 10 is threaded and locates a clamping plate 20 which can be adjusted towards and away from the cell base by means of a nut 22.

The clamping plates 20 are designed to bridge the space between a pair of cooling coils/cathodes 24 and the frame is so located that the studs 18 extend generally medially of adjacent pairs of coils 24. In use, the nuts 22 are adjusted to engage the plates 20 against the coils thereby forcing the frame downwardly to hold the layer 10 firmly against the cell base 12 and thereby prevent seepage of electrolyte beneath the layer 10.

Figure 4:
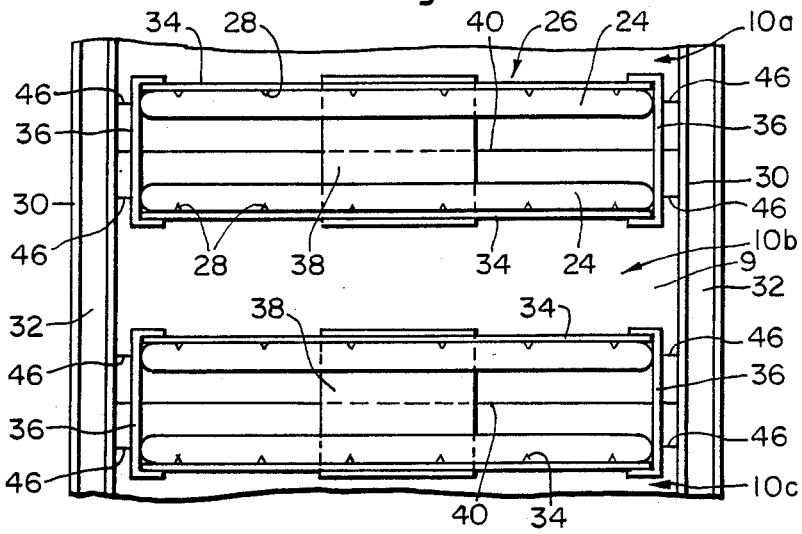
FIG. 4 is a diagrammatic plan view showing part only of a cell in which the cooling coils/cathodes are provided with protective barriers or guards (the anodes being omitted for clarity)
Figure 5:
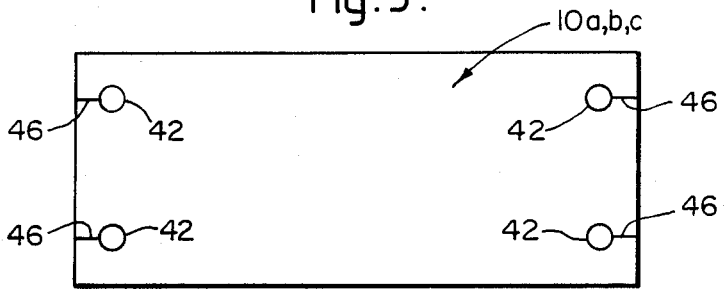
FIG. 5 is a plan view of one sheet of the insulating base layer.
Figure 6:
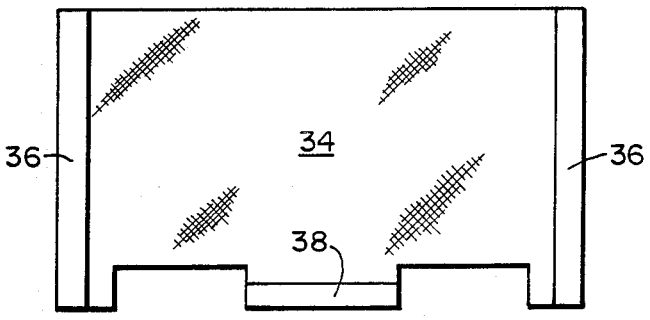
FIG. 6 is a front view of a protective barrier or guard.

FIGS. 4, 5 and 6 illustrate an alternative arrangement in which the cathode cooling coils 24 are provided with protective guards 26 which are secured to the coils by welds 28. In FIG. 4, reference 30 depicts the side walls of the cell tank and reference 32 depicts the side wall steam jackets. Each guard 26 comprises a box-section structure having main walls 34 of expanded metal which allow electrolyte flow therethrough but prevent large pieces of debris from impinging against the coils. The guard has channel-section sides 36 and at the bottom edge of the structure there is a channel-section bridging piece 38 which spans the space between the main walls 34. Each guard 26 engages the insulating layer 10 via the ends of the sides 36 and the bridging piece 38.

As shown in FIG. 4, the layer 10 is made up of a number of side-by-side sections 10*a, b, c* . . . , the abutting edges being depicted by reference 40. The arrangement is such that the joints 40 extend approximately medially of each pair of coils 24 so that the sections 10*a, b, c* . . . are held down against the cell base at their adjoining edges. It will be understood that the spaces between each pair of cooling coils will be occupied by anode assemblies (not shown).

FIG. 5 illustrates one of the sections 10*a, b, c* . . . . It is formed with a number of apertures 42 through which the vertical inlet and outlet pipe sections 44 (see FIG. 1) of the cooling coils extend as a close fit. A slit 46 extends from each aperture 42 to the adjacent short edge of the section 10*a, b, c* . . . to allow the section 10*a, b, c* . . . to be assembled to the pipe sections 44.

I claim:

1. A fluorine-generating electrolytic cell having a base, cooling coils in the cell for cooling the electrolyte and being displaced from the base, a layer of material disposed on the base to electrically insulate the base, and means bridging the space between the cooling coils and an upwardly presented face of the layer so as to hold the layer against the base.

2. A cell as claimed in claim 1, in which the layer comprises a number of sheets of plastics material arranged side-by-side.

3. A cell as claimed in claim 1, in which the layer comprises a fluorinated polymer.

4. A cell as claimed in claim 1, in which the layer comprises polypropylene.

5. A fluorine-generating electrolytic cell having a base, cooling coils in the cell for cooling the electrolyte, a layer of material disposed to electrically insulate the base, and means acting between the cooling coils and an upwardly presented face of the layer to hold the layer against the base, said means comprising one or more clamping members pressed against the layer by struts extending between the cooling coils and the clamping member or members.

6. A cell as claimed in claim 5, in which the clamping member comprises a frame to which the struts are secured.

7. A cell as claimed in claim 5, including one or more bridging pieces, each strut engaging a pair of cooling coils through the agency of a bridging piece, which bridging piece is adjustable lengthwise of the strut.

8. A fluorine-generating electrolytic cell having a base, cooling coils in the cell for cooling the electrolyte, a layer of material disposed to electrically insulate the base, and means acting between the cooling coils and an upwardly presented face of the layer to hold the layer against the base, the cooling coils being provided with protective barriers attached to the coils, and the protective barriers being arranged to seat against the layer to hold the layer against the cell base.

* * * * *